US010774578B2

(12) United States Patent
Raz

(10) Patent No.: US 10,774,578 B2
(45) Date of Patent: Sep. 15, 2020

(54) DOOR WITH SUPPLEMENTARY HINGE-SIDE ENGAGEMENT

(71) Applicant: Dan Raz Ltd., Tirat Carmel (IL)

(72) Inventor: Amir Raz, Haifa (IL)

(73) Assignee: Dan Raz Ltd., Tirat Carmel (IL)

( * ) Notice: Subject to any disclaimer, the term of this patent is extended or adjusted under 35 U.S.C. 154(b) by 217 days.

(21) Appl. No.: 15/758,348

(22) PCT Filed: Aug. 18, 2016

(86) PCT No.: PCT/IL2016/050906
§ 371 (c)(1),
(2) Date: Mar. 8, 2018

(87) PCT Pub. No.: WO2017/042799
PCT Pub. Date: Mar. 16, 2017

(65) Prior Publication Data

US 2018/0252025 A1 Sep. 6, 2018

(30) Foreign Application Priority Data

Sep. 9, 2015 (IL) ..... 241392

(51) Int. Cl.

| | |
|---|---|
| ***E06B 5/11*** | (2006.01) |
| *E06B 3/70* | (2006.01) |
| *E06B 3/76* | (2006.01) |
| *E06B 3/72* | (2006.01) |
| *E06B 7/36* | (2006.01) |

(52) U.S. Cl.
CPC ..... *E06B 5/113* (2013.01); *E06B 3/72* (2013.01); *E06B 3/76* (2013.01); *E06B 7/367* (2013.01); *E06B 2003/7074* (2013.01)

(58) Field of Classification Search
CPC ..... E06B 3/88; E06B 5/113
See application file for complete search history.

(56) References Cited

U.S. PATENT DOCUMENTS 772,611 A * 10/1904 Ferrara ..... E06B 7/367 49/383
894,754 A * 7/1908 Snaman ..... A01K 3/002 49/33

(Continued)

FOREIGN PATENT DOCUMENTS

GB 2154639 9/1985
GB 2195958 4/1988

(Continued)

*Primary Examiner* — Catherine A Kelly
(74) *Attorney, Agent, or Firm* — Mark M. Friedman

(57) ABSTRACT

A door or window assembly includes an opening bounded by a frame including a hinge jamb (12). A panel (18) is hung relative to the hinge jamb via a hinge arrangement (20) so as to swing between an open position and a closed position. An engagement configuration includes a ledge (22) located in fixed relation to the hinge jamb, and a flange (24) rigidly associated with the panel. The engagement configuration allows me panel to swing freely between open and closed positions. In the closed position, the flange (24) is brought into facing relation with the ledge (22) such that force directed to displace the panel (18) within the plane of closure away from the hinge jamb (12) acts to bring the flange into engagement with the ledge.

18 Claims, 20 Drawing Sheets

(56) References Cited

U.S. PATENT DOCUMENTS 1,231,069 A * 6/1917 Schaffert ..... E06B 3/12 49/401
1,949,581 A * 3/1934 Place ..... E05F 1/1215 49/398
1,973,461 A * 9/1934 Barringer ..... E06B 7/232 49/483.1
2,572,717 A 10/1951 Gersten
2,597,174 A * 5/1952 Patton ..... E05D 3/02 49/398
3,634,962 A 1/1972 Peterson
4,126,965 A 11/1978 Hoffmann
4,130,311 A * 12/1978 Sushan ..... E05B 17/2003 292/346
4,178,859 A 12/1979 Eickhoff et al.
4,290,233 A * 9/1981 Hubbard ..... E06B 7/362 49/383
5,137,327 A 8/1992 Edmonds et al.
5,660,021 A * 8/1997 Wolgamot ..... B32B 7/02 52/783.12
5,845,433 A * 12/1998 Walsh ..... E05D 11/0027 49/383
6,564,428 B2 * 5/2003 Richard ..... E05D 3/127 16/335
7,000,550 B1 2/2006 Mandall
7,748,606 B2 * 7/2010 Mikolajczyk ..... A47G 29/1201 232/45
7,866,368 B2 * 1/2011 Ostrovsky ..... E05D 15/165 160/201
8,171,866 B2 * 5/2012 Dunstan ..... E05D 3/12 109/70
8,453,384 B2 * 6/2013 Boyer ..... E06B 7/36 49/383
8,707,625 B2 4/2014 Raz et al.
9,598,894 B2 3/2017 Raz
9,752,364 B2 * 9/2017 James ..... E05D 11/1014
9,970,214 B2 5/2018 Raz
9,988,830 B2 6/2018 Raz
10,138,654 B2 11/2018 Raz
2002/0095885 A1 7/2002 Sampson
2008/0040976 A1 * 2/2008 Salzer ..... E06B 5/113 49/50
2008/0289547 A1 * 11/2008 Wakamatsu ..... E06B 5/11 109/76
2009/0289065 A1 11/2009 Sampson
2014/0190098 A1 7/2014 Raz et al.
2015/0121766 A1 * 5/2015 Jeong ..... E06B 7/36 49/462
2018/0209175 A1 7/2018 Raz

FOREIGN PATENT DOCUMENTS

WO 2013001488 1/2013
WO 2017033177 3/2017
WO 2017042799 3/2017
WO 2017149544 9/2017
WO 2017149545 9/2017

* cited by examiner

DOOR WITH SUPPLEMENTARY HINGE-SIDE ENGAGEMENT

FIELD AND BACKGROUND OF THE INVENTION

The present invention relates to hinged closures such as doors and windows and, in particular, it concerns a hinged closure with supplementary engagement at the hinge-side of the panel.

In a wide range of applications, it is desirable to provide hinged closures with reinforcement. For example, in security doors, it is known to provide a number of pins projecting from the door which engage corresponding holes in the hinge jamb, thereby providing enhanced resistance to forces trying to force the panel away from the frame.

Such pins generally project within the plane of the panel, such that they do not oppose forces that would tend to pull the panel away from the hinge jamb within the plane of the door frame. Such forces may occur under a range of circumstances, such as when a panel becomes bowed under an impact or blast.

SUMMARY OF THE INVENTION

The present invention provides various embodiments of a hinged closure with supplementary engagement at the hinge-side of the panel.

According to the teachings of an embodiment of the present invention there is provided, an apparatus comprising: (a) an opening bounded by a frame including a hinge jamb, the frame defining a plane of closure; (b) a panel; (c) a hinge arrangement associated with the panel and the hinge jamb and configured to hang the panel relative to the opening so as to be swingable between an open position removed from the opening and a closed position in which the panel is aligned parallel to the plane of closure within the opening; and (d) an engagement configuration comprising: (i) a ledge located in fixed relation to the hinge jamb, and (ii) a flange rigidly associated with the panel, the engagement configuration being configured such that the panel swings freely between the open position and the closed position, and such that, when the panel assumes the closed position, the flange is brought into facing relation with the ledge such that force directed to displace the panel within the plane of closure away from the hinge jamb acts to bring the flange into engagement with the ledge.

According to a further feature of an embodiment of the present invention, the flange is part of a closed profile forming at least part of the panel.

According to a further feature of an embodiment of the present invention, the closed profile is formed from at least one layer of sheet metal bent to form the flange and the closed profile.

According to a further feature of an embodiment of the present invention, the closed profile is formed from a single piece of sheet material bent so as to form the flange and the closed profile.

According to a further feature of an embodiment of the present invention, the closed profile is an extruded profile.

According to a further feature of an embodiment of the present invention, the panel is formed from at least two sheets of metal each extending substantially an entire width of the panel.

According to a further feature of an embodiment of the present invention, the closed profile includes an elongated recess, and wherein the panel includes a sheet of metal formed with a lateral folded lip, the elongated recess and the lateral folded lip being configured for sliding interengagement.

According to a further feature of an embodiment of the present invention, the closed profile further comprises a shoulder, and wherein the hinge jamb further comprises an abutment surface, the shoulder and the abutment surface being deployed such that, when the panel assumes the closed position, the shoulder and the abutment surface are brought into facing relation such that force directed to displace the panel within the plane of closure towards the hinge jamb acts to bring the shoulder into engagement with the abutment surface.

According to a further feature of an embodiment of the present invention, the flange and the shoulder are in facing relation defining between them an elongated recess of the closed profile, and wherein the ledge and the abutment surface are integrated into a projecting ridge of the hinge jamb, the projecting ridge coming into engagement with the elongated recess when the panel assumes the closed position.

According to a further feature of an embodiment of the present invention, the hinge jamb further comprises an abutment surface, the abutment surface being in facing relation with the ledge so as to define therebetween an elongated hinge-jamb recess, the flange being deployed to engage the elongated hinge jamb recess when the panel assumes the closed position with the flange in facing relation with the abutment surface such that force directed to displace the panel within the plane of closure towards the hinge jamb acts to bring the flange into engagement with the abutment surface.

According to a further feature of an embodiment of the present invention, the flange is part of a flange-extension rigidly attached to the panel.

According to a further feature of an embodiment of the present invention, the flange extension is bolted to the panel.

According to a further feature of an embodiment of the present invention, the flange extension is geometrically interlocked with the panel.

According to a further feature of an embodiment of the present invention, the flange extension extends along a majority of a dimension of the panel parallel to the hinge jamb.

According to a further feature of an embodiment of the present invention, the hinge arrangement includes a hinge support strip fixedly attached to the hinge jamb and extending along a majority of a length of the hinge jamb, and wherein the ledge is provided by an internal face of a slot formed in and extending along, the hinge support strip.

According to a further feature of an embodiment of the present invention, the hinge support strip supports a plurality of hinge pin elements spaced along the hinge jamb, wherein a sum total length of the hinge pin elements is less than a sum total length of the ledge.

According to a further feature of an embodiment of the present invention, the engagement configuration is configured such that contact between the flange and the ledge occurs only on application of sufficient force to cause damage to the hinge arrangement.

According to a further feature of an embodiment of the present invention, the frame further comprises a strike jamb, and wherein the panel further comprises a lock mechanism having a locking element displaceable to engage the strike jamb.

According to a further feature of an embodiment of the present invention, the locking element is a hook element configured to engage the strike jamb so as, to oppose forces directed to pull the panel away from the strike jamb.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 2:
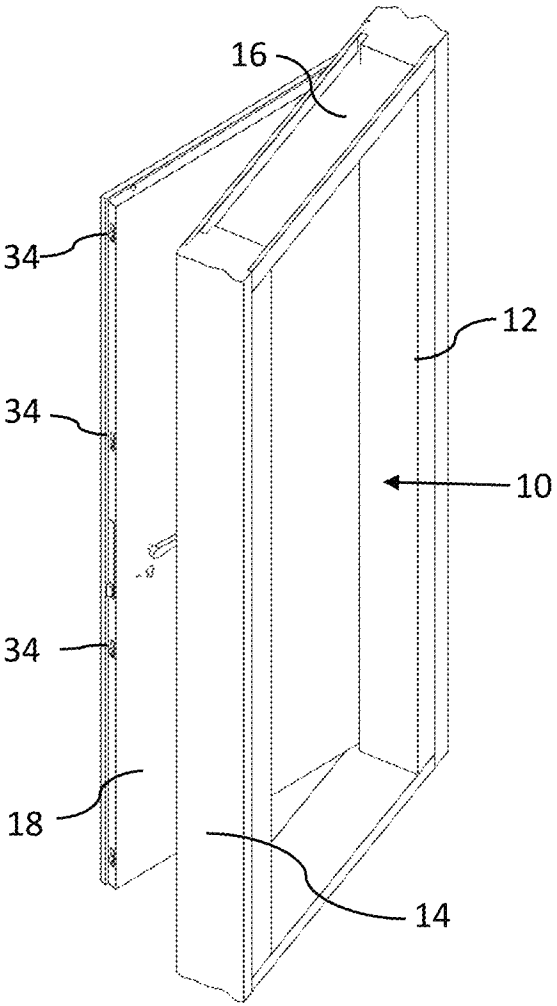
FIG. 2 is a schematic isometric view of the door assembly of FIG. 1 with the surrounding wall cut-away, the door assembly shown with the panel partially open.
Figure 1:
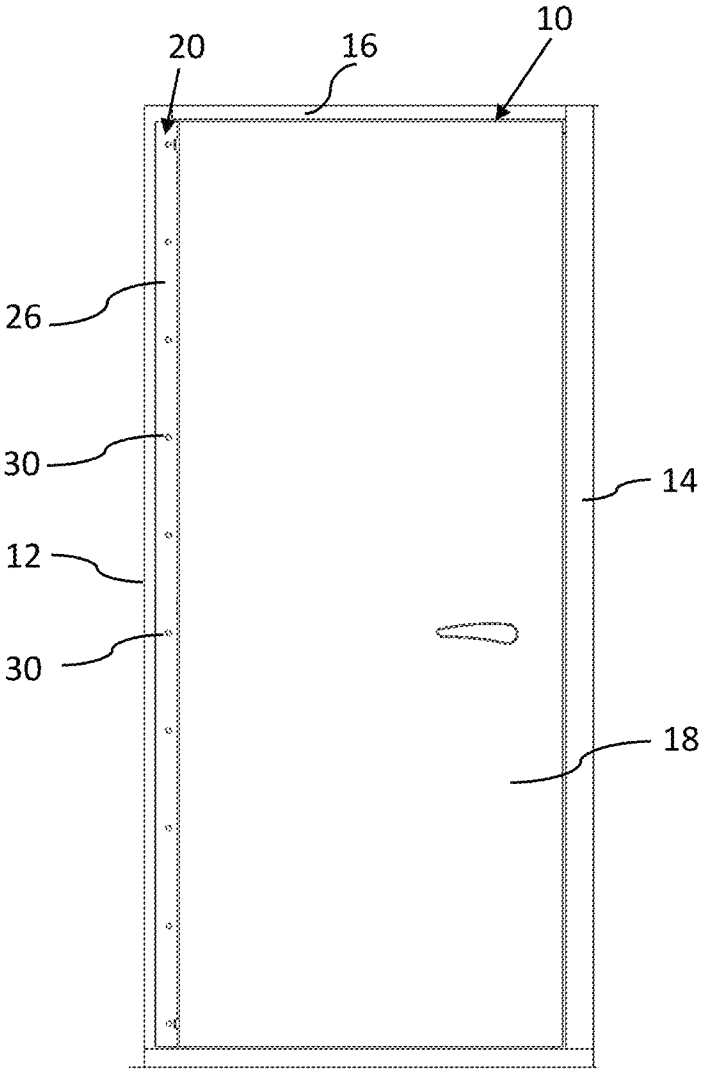
FIG. 1 is a front view of a door assembly, constructed an operative according to an embodiment of the present invention, including a panel closing a doorway.
Figure 3B:
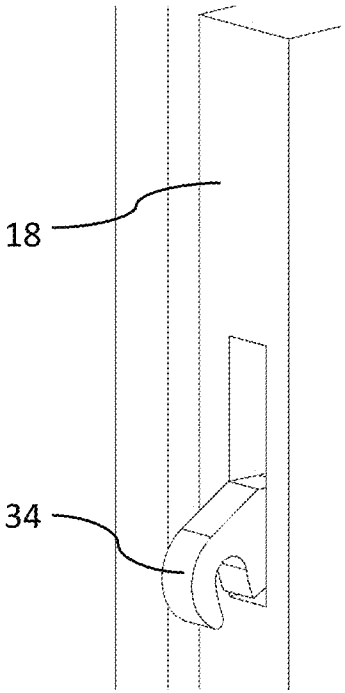
FIGS. 3A and 3B are enlarged schematic isometric views of a region of the panel of FIG. 1 illustrating a locking element in a retracted and a deployed state, respectively.
Figure 3A:
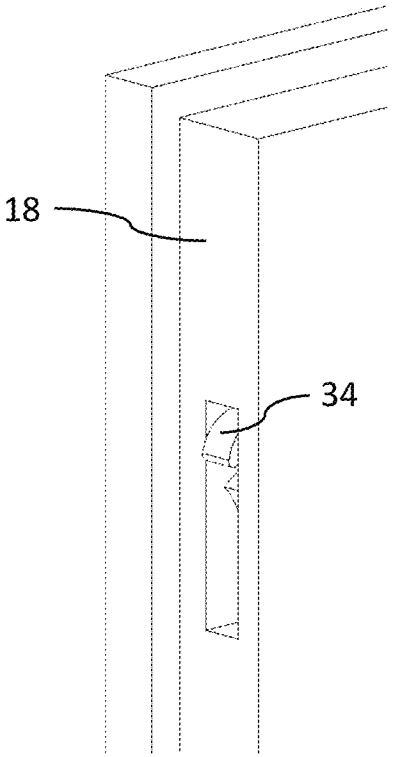
Figure 4B:
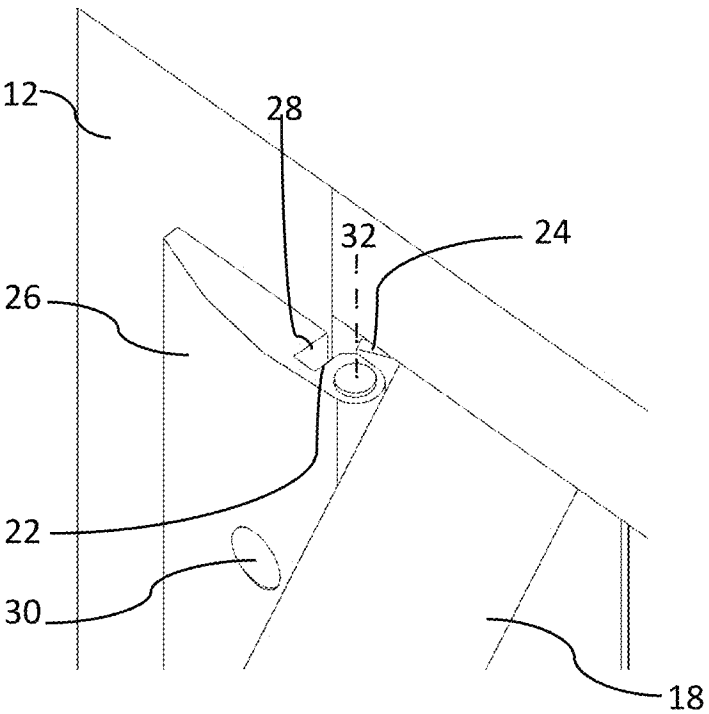
FIGS. 4A and 4B are enlarged isometric views of the door assembly of FIG. 1 illustrating an engagement configuration of the door assembly, shown with the panel in a closed and a partially-open state, respectively.
Figure 4A:
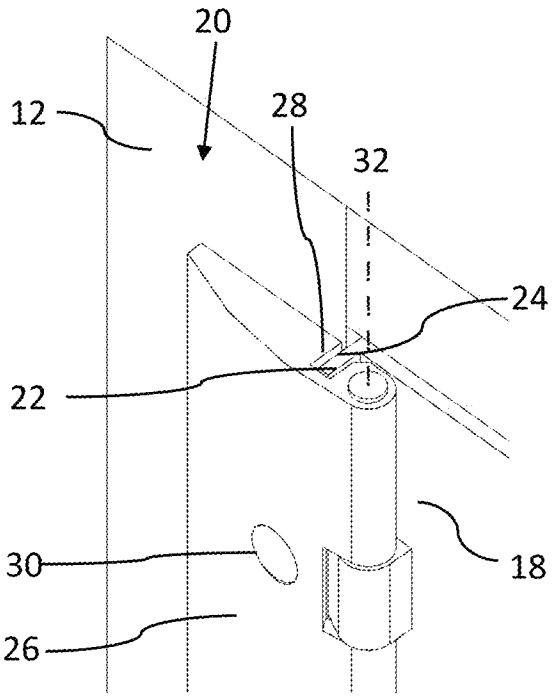

The present invention is an apparatus that provides a closure to a doorway or other opening.

The principles and operation of apparatus according to the present invention may be better understood with reference to the drawings and the accompanying description.

By way of introduction, it should be noted that reference is made herein to "doors" and "doorways" as non-limiting typical examples, but that the corresponding description should be understood to apply equally to other types of openings, such as for example windows.

Referring now to the drawings, FIGS. 1-5D illustrate an apparatus constructed and operative according to an embodiment of the present invention. Generally speaking, the apparatus includes an opening 10 hounded by a frame including a hinge jamb 12, typically in combination with a strike jamb 14 and a lintel 16. The frame defines a "plane of closure", which is intuitively defined as the plane of the opening to be closed by a closure (panel), typically corresponding to a plane intersecting with the frame around an entire periphery of the frame.

The apparatus also includes a panel 18 which is hung on (i.e., mounted to) hinge jamb 12 via a hinge arrangement 20 so as to be swingable between an open position removed from opening 10 and a closed position in which panel 18 is aligned parallel to the plane of closure within opening 10.

It is a particular feature of certain preferred embodiments of the present invention that the apparatus is also provided with an engagement configuration including a ledge 22 located in fixed relation to hinge jamb 12, and a flange 24 rigidly associated with panel 18. The engagement configuration is configured such that it does not obstruct free swinging of the panel between the open position (FIGS. 5B and 5C) and the closed position (FIG. 5A), and such that, when the panel assumes the closed position, the flange is brought into facing relation with the ledge such that force directed to displace panel 18 within the plane of closure away from hinge jamb 12 acts to bring flange 24 into engagement with ledge 22.

Certain preferred embodiments of the present invention thus provide greatly enhanced anchoring of panel 18 to hinge jamb 12. Specifically, under conditions of high strain, such as from a blast wave or from a heavy mechanical impact, a panel may be subjected to forces sufficient to damage and compromise support of panel 18 via pin elements of hinge arrangement 20. The engagement configuration illustrated here is highly effective even when forces act to try to separate panel 18 from hinge jamb 12 within the plane of closure, such as may occur on bowing of panel 18. The engagement configuration of flange 24 and ledge 22, which may advantageously extend along a greater portion of the height of the hinge jamb 12 than the extent of the hinge pin elements, and most preferably, along a majority of the height dimension of hinge jamb 12, provides highly effective retention of panel 18 against separation from hinge jamb 12, even under in-plane forces.

A further feature of certain embodiments of the present invention as illustrated here is that hinge arrangement 20 includes a hinge support strip 26 fixedly attached to an outward facing surface of hinge jamb 12 and extending along a majority of a length of the hinge jamb. In this case, ledge 22 is preferably provided by an internal face of a slot 28 formed in, and extending along, hinge support strip 26. The use of hinge support strip 26 fixed to an outward facing surface of hinge jamb 12 renders this configuration of the present invention highly suitable for retrofit adaptation of a conventional doorframe. Since attachment is over a large area, for example via a series of spaced-apart bolts 30 (see FIG. 1), hinge support strip 26 can be strongly anchored to hinge jamb 12 to withstand forces up to required specifications for a wide range of applications.

It should be noted that the principles of the present invention are applicable both to inward-opening and outward-opening panels. In cases in which a panel is outward-opening, the hinge support strip 26 may be rendered tamper-resistant by use of countersunk bolts with drilled-out heads, or by using through-the-wall anchoring elements which are secured from the inside of a building (not shown). In some cases, configurations in which the components forming the engagement configuration are completely concealed from view, such as those of FIGS. 8-11B, described below, may be preferred for outward-opening panels.

Figure 5E:
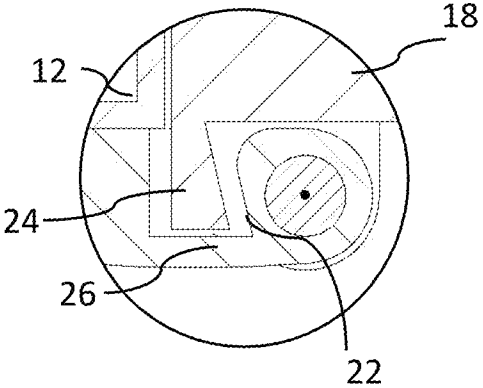
FIGS. 5E and 5F are partial enlarged views of two variant implementations of an engagement configuration shown in FIG. 5A.
Figure 5F:
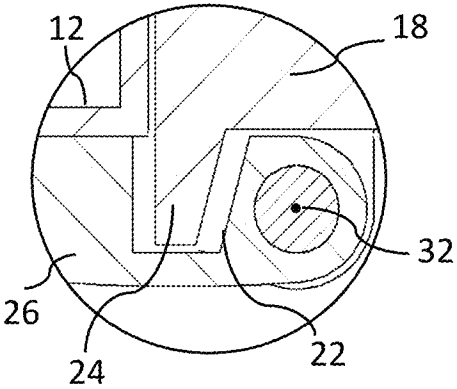
Figure 5A:
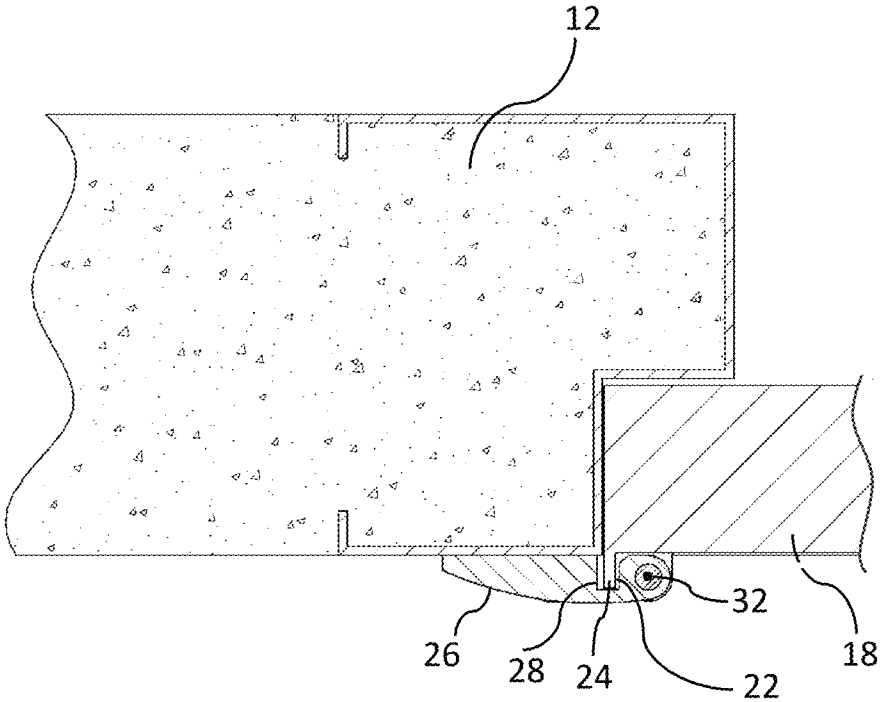
FIGS. 5A-5C are partial horizontal cross-sectional views taken through the door assembly of FIG. 1 showing the region of the hinge jamb with the engagement configuration with the panel in a closed state, partially-open state and fully-open state, respectively.
Figure 5B:
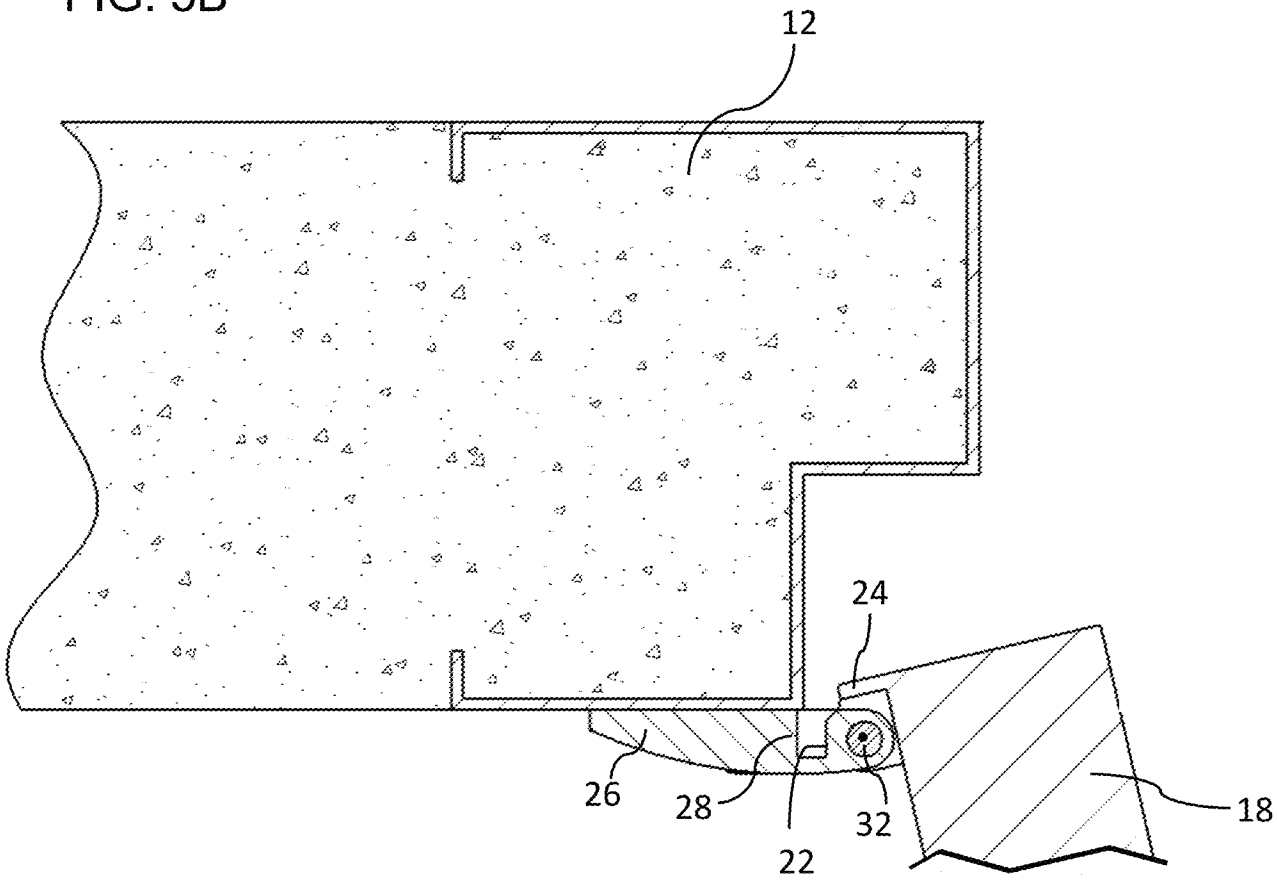
Figure 5C:
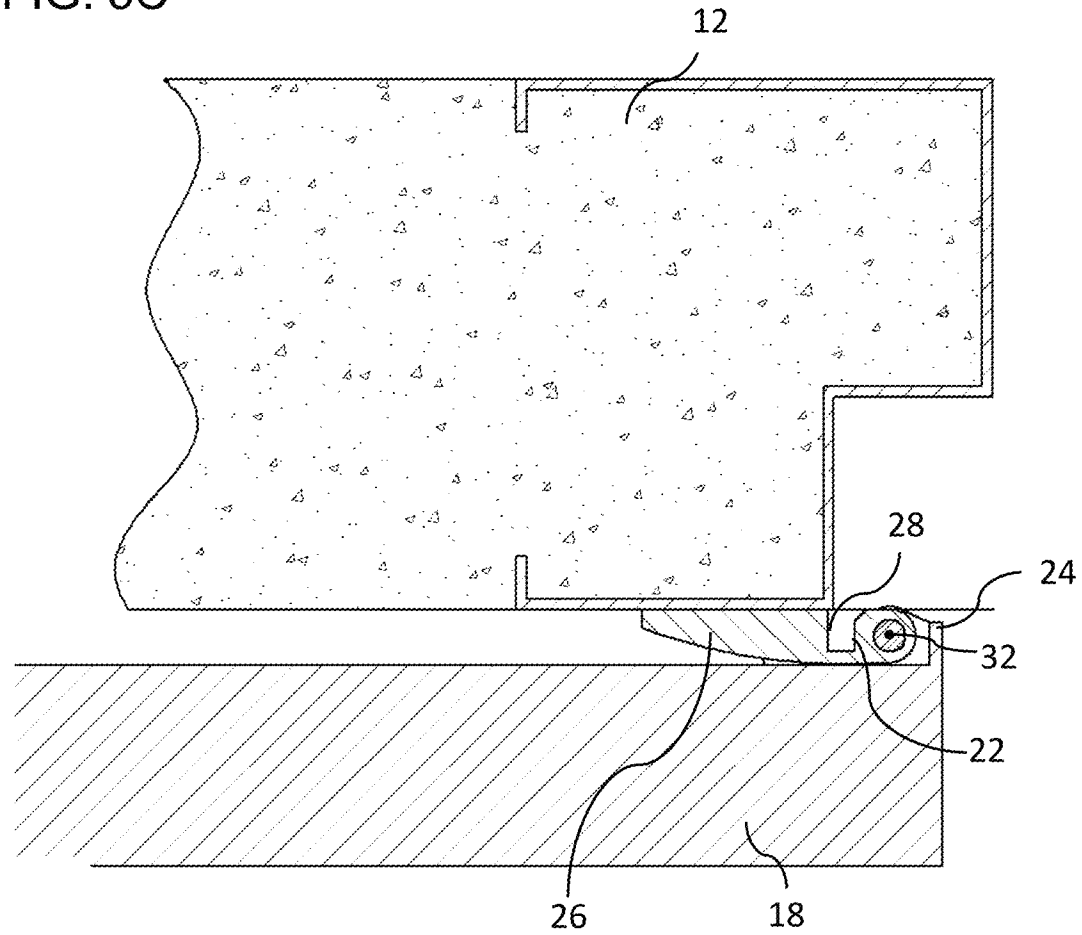
Figure 5D:
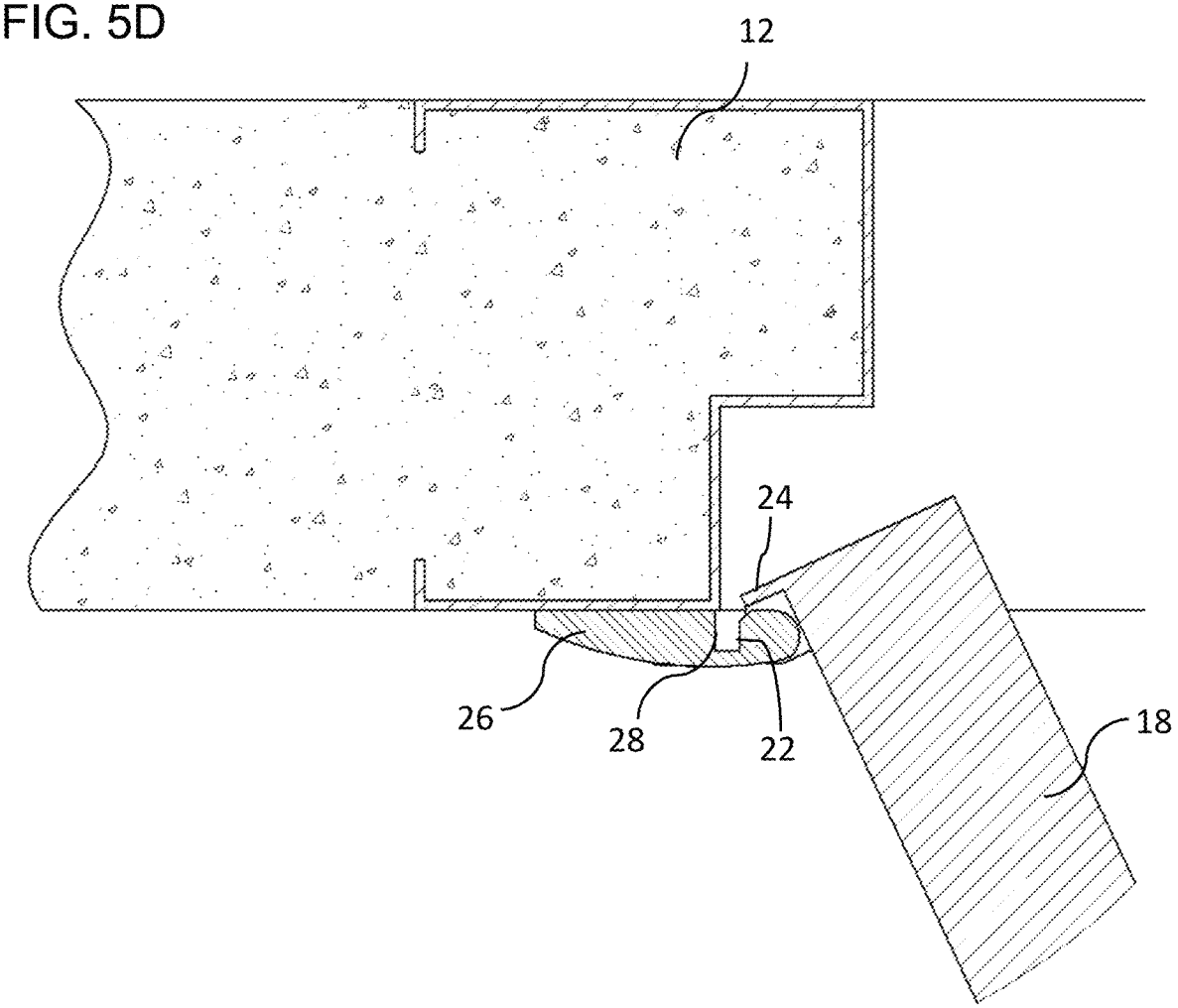
FIG. 5D is a view similar to FIG. 5B taken at a different height such that it does not intersect the a pin element of the hinge.

According to one non-limiting preferred example illustrated here, the hinge axis 32 provided by hinge support strip 26 is located set-in from the edge of the panel, such that flange 24 which projects from the extremity of the door undergoes motion with an outward component at the end of the closing motion of the door, thereby engaging slot 28. The hinge axis position is also outside the plane of the panel. In other words, if the main body of panel 18 is viewed as bounded by two planes, at the front and back surfaces of the panel, hinge axis 32 is, located outside the space bounded by those planes, and slightly spaced therefrom. This configuration also facilitates a large angle of motion of panel 18, for example, in excess of 160°, and in some cases approximately 180°, as illustrated in FIG. 5C.

As mentioned above, the hinge pin elements defining hinge axis 32 support panel 18 for normal hinged motion, but are not the primary load-bearing elements in case of extreme loading. For this reason, in certain preferred implementations, hinge support strip 26 supports a plurality of hinge pin elements spaced along hinge jamb 12, where a sum total length of the hinge pin elements is less than a sum total length of ledge 22. Typically, the engagement configuration is configured with a clearance space between the facing surfaces such that contact between flange 24 and ledge 22 occurs only on application of sufficient force to cause damage to hinge arrangement 20.

The orientations of the facing surfaces of flange 24 (when the panel is closed) and ledge 22 as illustrated here are perpendicular to the plane of closure and run parallel to the length of hinge jamb 12. Optionally, a slight undercut angle may be provided (FIG. 5E) so that, under a load, flange 24 and ledge 22 lock against each other and cannot be released without pushing the panel back towards the hinge jamb. Conversely, implementations with a slight release angle (FIG. 5F) also fall within the scope of the present invention, and this may provide additional design freedom for implementation of the engagement configuration so that it does not impinge on the freedom of swinging motion of the panel. Any such release angle should be sufficiently small that frictional engagement between surfaces of flange 24 and ledge 22 negates any tendency to slide across each other and release engagement under an applied load.

It should be appreciated that the hinge-side reinforcements of the present invention may be used to advantage with any and all types, of panels and locking mechanisms. In many cases, panel 118 features a lock mechanism having one or more locking elements 34 displaceable to engage the strike jamb. The lock mechanism may be any conventional lock mechanism, and for conciseness, will not be described here in detail. In certain particularly preferred implementations, some or all of locking elements 34 are hook elements (FIGS. 3A and 3B) configured to engage the strike jamb 14 so as to oppose forces directed to pull the panel away from the strike jamb. This engagement complements the supplementary hinge jamb side engagement so as to provide highly effective retention of panel 18 within the opening under a wide range of loading conditions.

Figure 6:
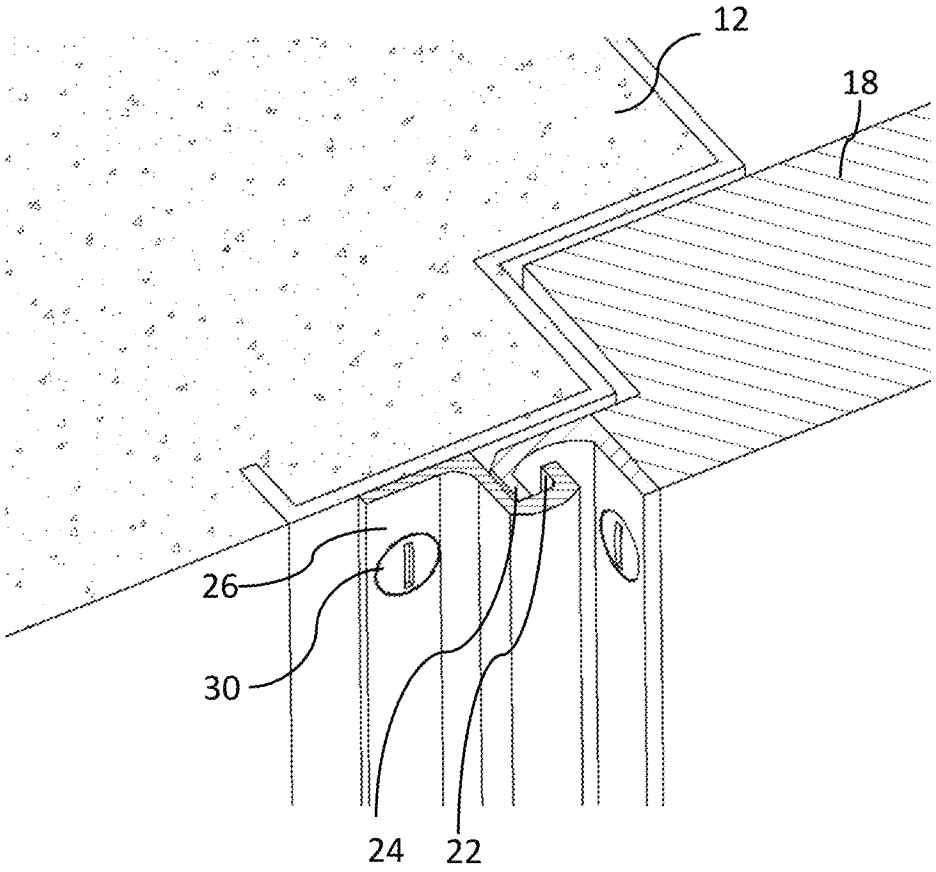
FIG. 6 is a partial, cut-away isometric view of the door assembly of FIG. 1 illustrating a variant implementation of an engagement configuration, constructed and operative according to an embodiment of the present invention, shown with the panel in a closed state.
Figure 7B:
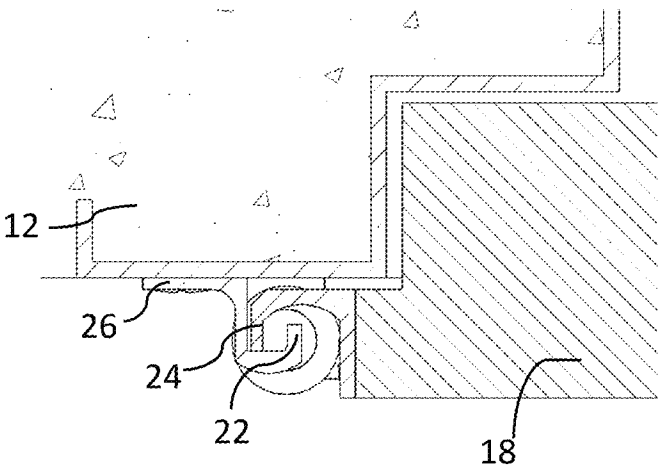
FIGS. 7B-7D are horizontal cross-sectional views taken through the embodiment of FIG. 6 not passing through a hinge pin element, shown with the panel in a closed state, a partially-open state and a further-open state, respectively.
Figure 7A:
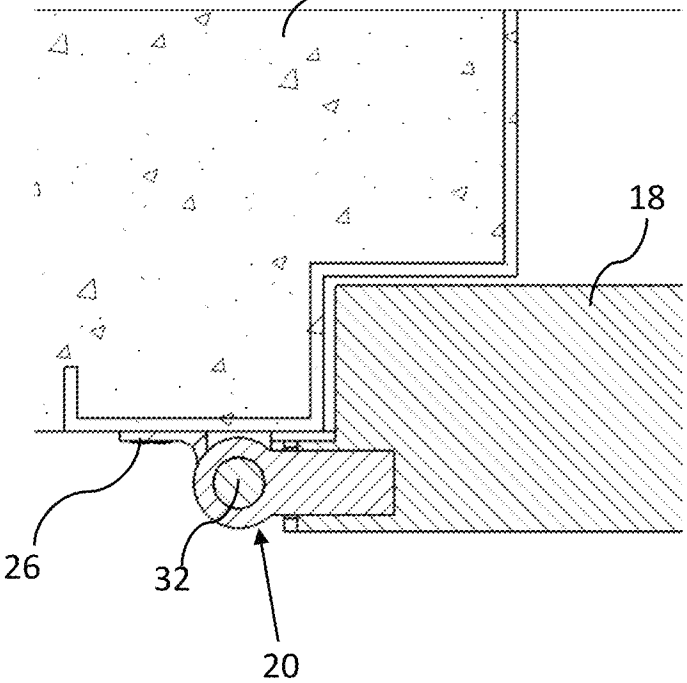
FIG. 7A is a horizontal cross-sectional view taken through the embodiment of FIG. 6 with the panel in a closed state, the cross-section being taken in a region of a hinge pin, element.
Figure 7D:
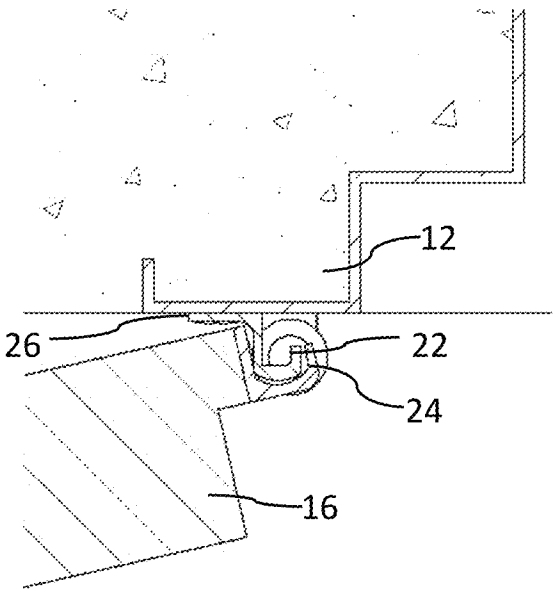
Figure 7C:
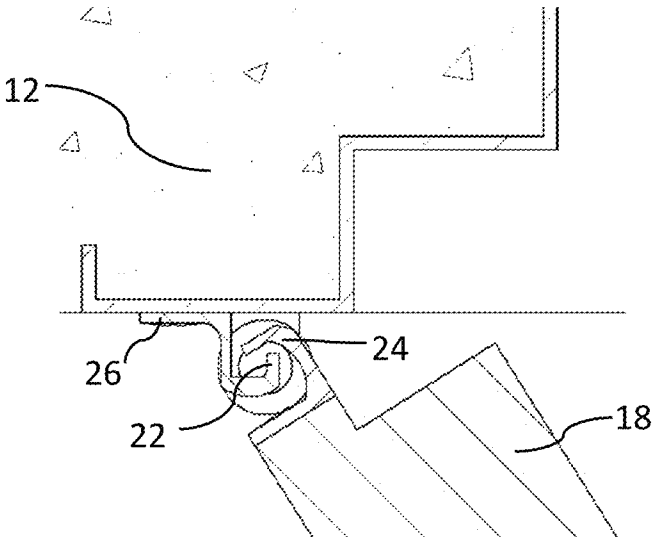

Turning now to FIGS. 6 and 7A-70, these illustrate a variant implementation of hinge support strip 26 and flange 24. In this case, hinge axis 32 is located to the side of panel 18 (not set in, from the edge as above), and the engagement configuration is formed by two complementary profiles. A first profile, integrated with hinge support strip 26, extends outwards from hinge jamb 12 and bends over to provide ledge 22. A second profile, bolted or otherwise fixed to (or integrally formed with) panel 18, has a U-shaped profile which provides flange 24. These profiles preferably extend along a majority of a height of the hinge jamb and panel, interrupted at a number of locations by a conventional hinge structure (see FIG. 7A). The resulting engagement configuration is structurally and functionally equivalent to that of FIGS. 1-5D described above, and will not be described here in further detail.

Turning now to FIGS. 8-18B, these illustrate alternative configurations of the hinge side engagement of the present invention which require a modified (i.e., non-standard) hinge jamb structure. Specifically, in these cases, ledge 22 is formed as a ledge internal to hinge jamb 12, within an internal recess 36 within hinge jamb 12. This ensures that the engagement configuration is tamperproof when closed, and facilitates implementations for bearing particularly large loads.

Figure 8:
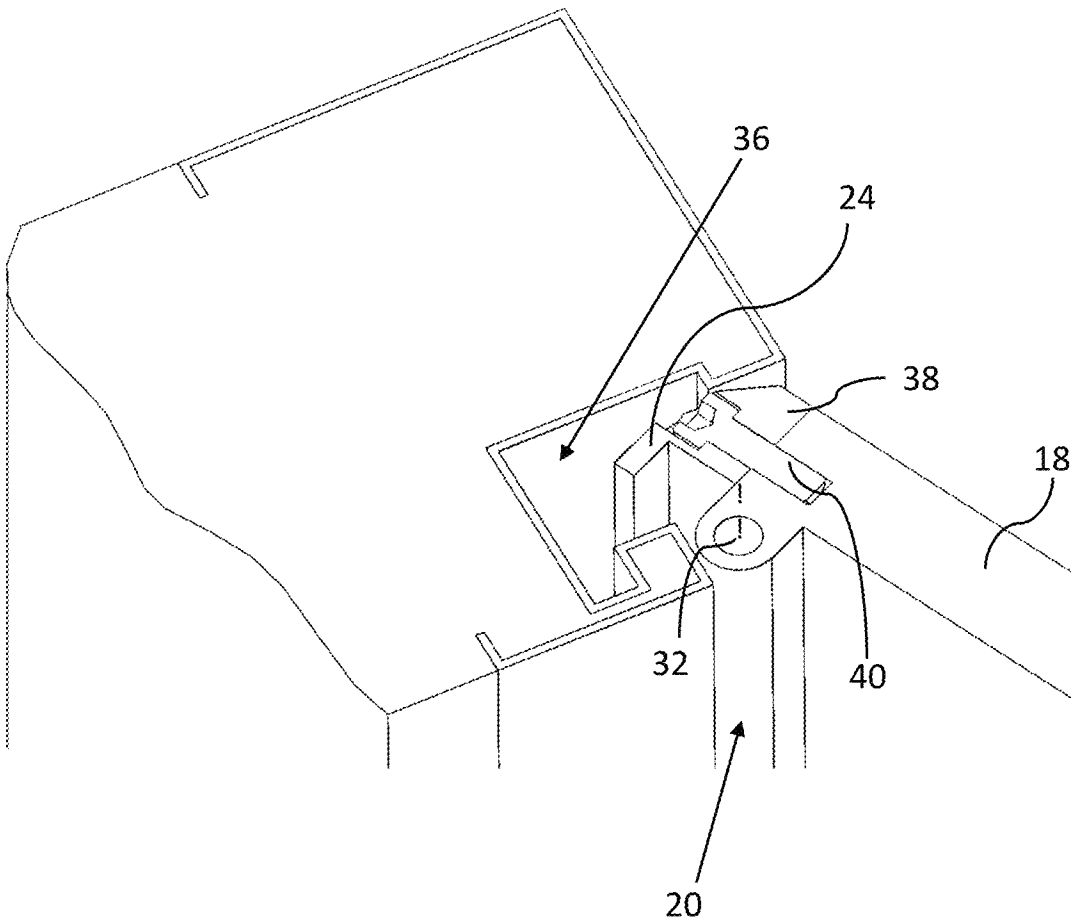
FIG. 8 is a partial, cut-away isometric view of the door assembly of FIG. 1 illustrating a further variant implementation of an engagement configuration, constructed and operative according to an embodiment of the present invention, shown with the panel in a partially-open state.
Figure 9A:
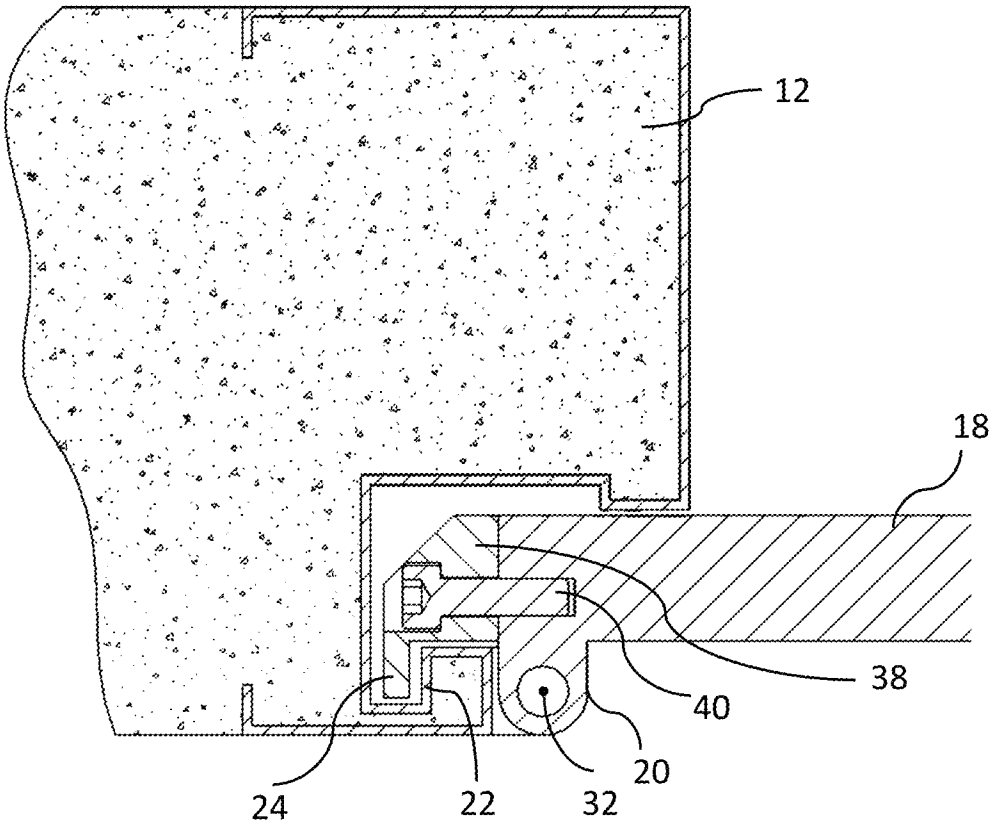
FIGS. 9A and 9B are horizontal cross-sectional views taken through the embodiment of FIG. 8, shown with the panel in a closed state and a partially-open state, respectively.
Figure 9B:
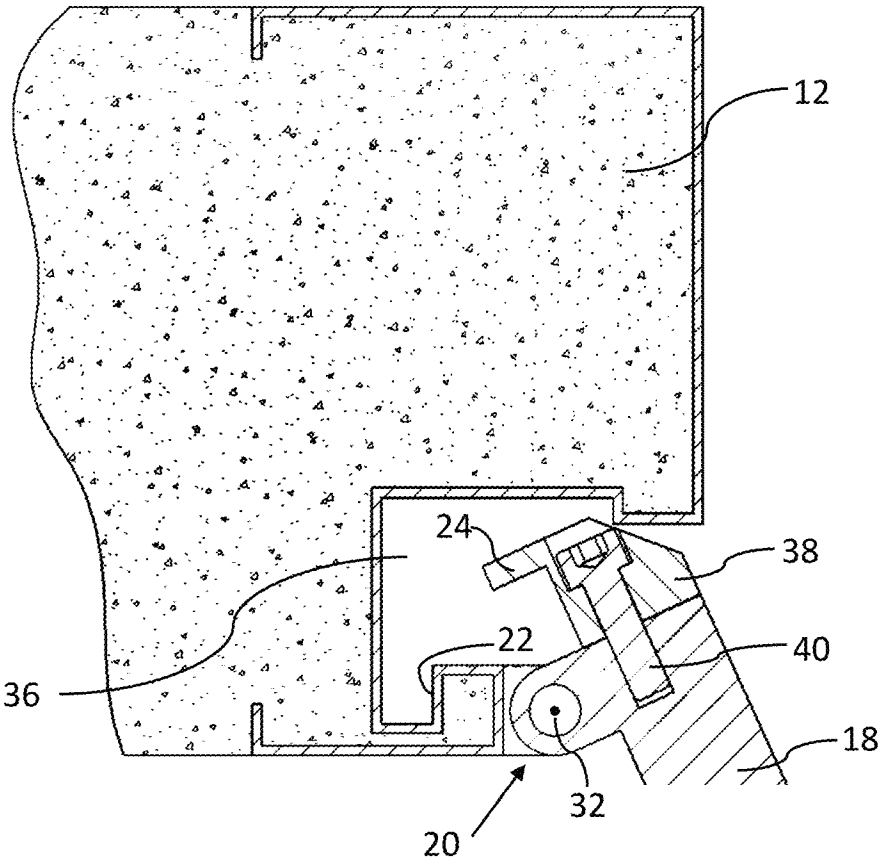

In FIGS. 8-11B, flange 24 as illustrated here is part of a flange-extension 38 rigidly attached to panel 18. In the example of FIGS. 8-9B, flange extension 38 is bolted to the panel by a set of spaced-apart bolts 40 anchoring the flange extension to the main part of panel 18. Flange extension 38 preferably extends along a majority, and most preferably the entirety, of a dimension of panel 18. In this case, the engagement configuration is spaced from the hinge arrangement 20 such that the engagement configuration can be continuous, or near continuous, along the height of panel 18.

Figure 10:
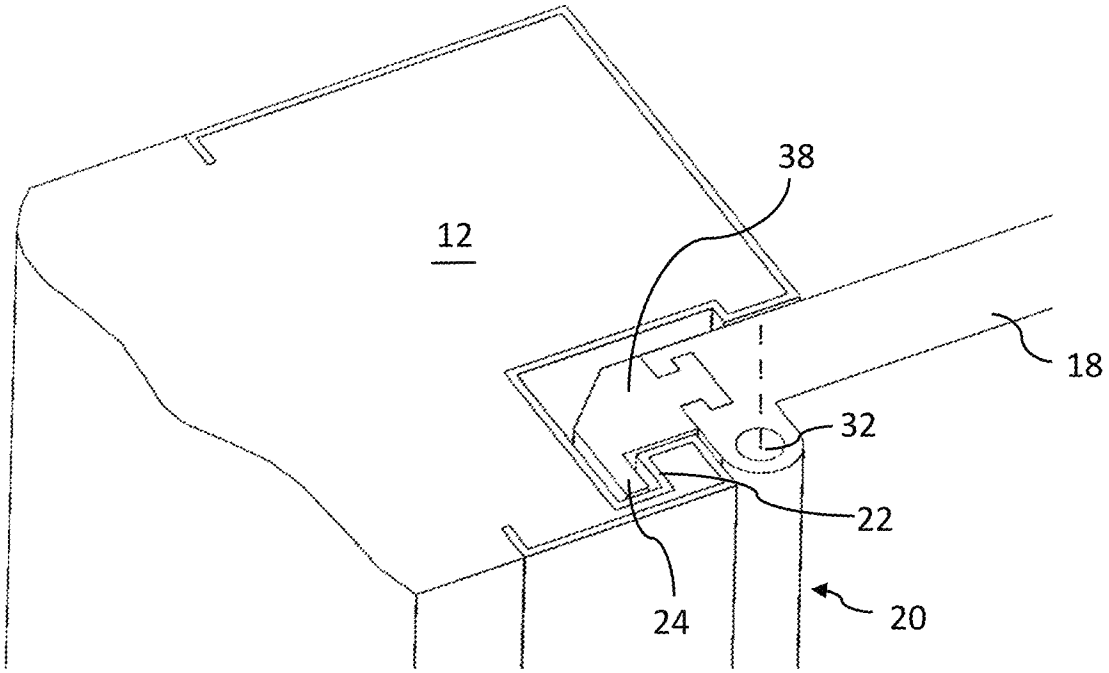
FIG. 10 is a partial, cut-away isometric view of the door assembly of FIG. 1 illustrating a further variant implementation of an engagement configuration, constructed and operative according to an embodiment of the present invention, shown with the panel in a closed state.
Figure 11A:
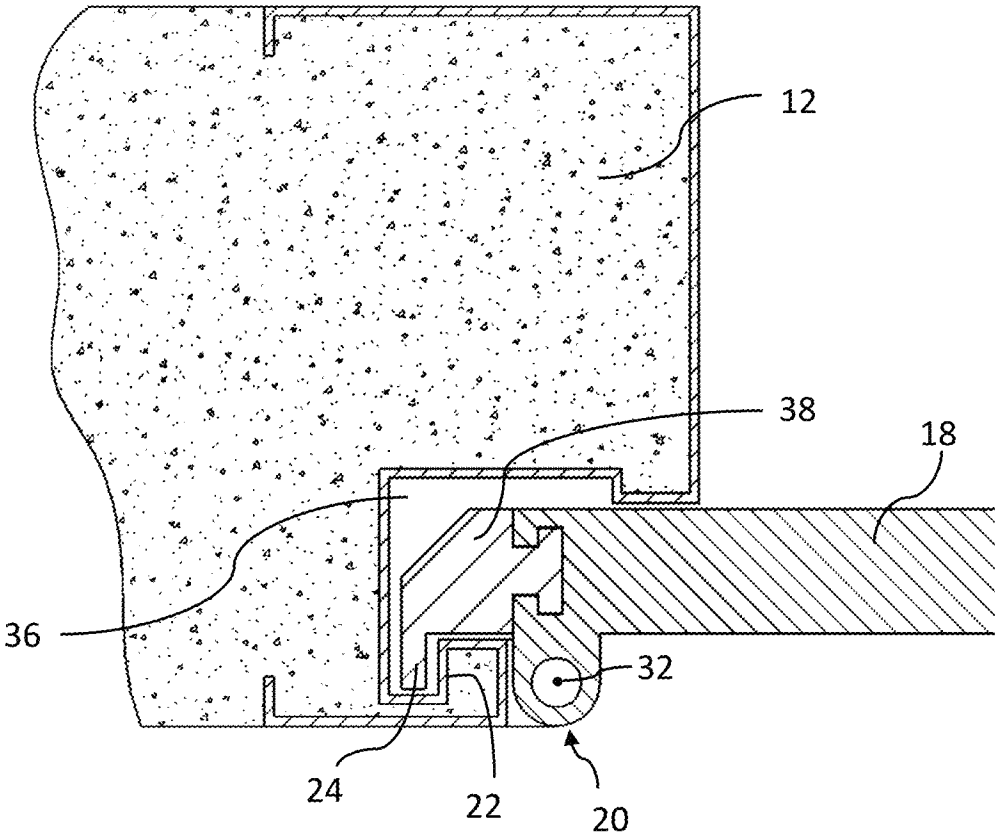
FIGS. 11A and 11B are horizontal cross-sectional views taken through the embodiment of FIG. 10, shown with the panel in a closed state and a partially-open state, respectively.
Figure 11B:
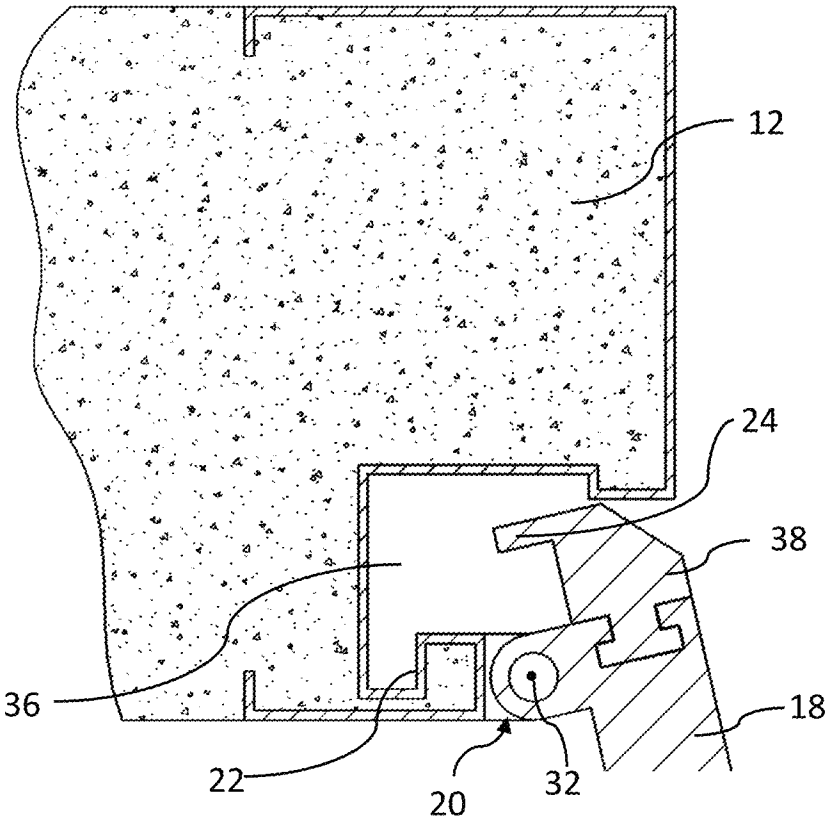
Figure 13A:
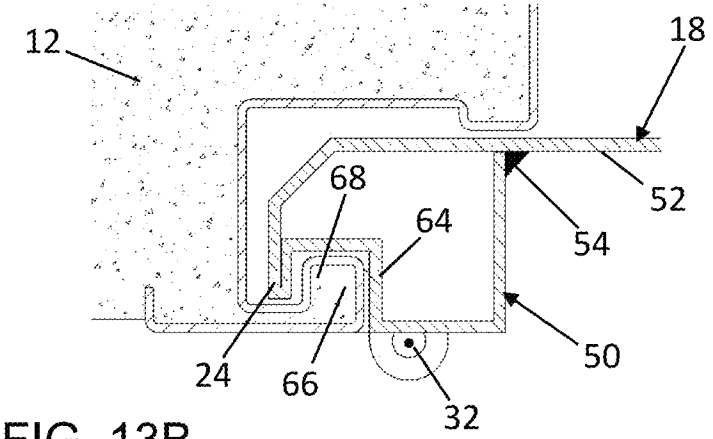
FIGS. 13A and 13B are partial, horizontal cross-sectional views taken through the door assembly of FIG. 12, shown with the panel in a closed state and a partially-open state, respectively.
Figure 13B:
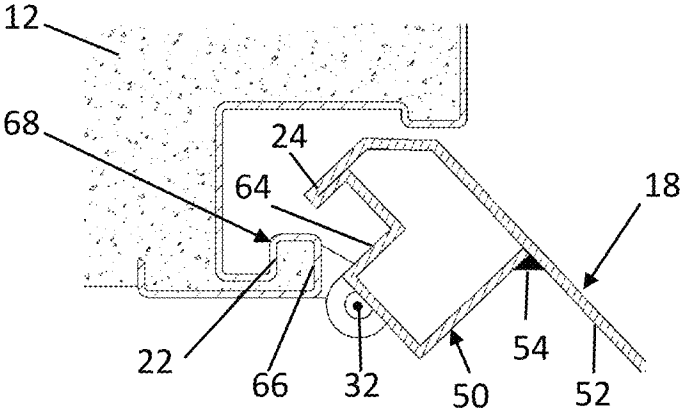

The example of FIGS. 10-11B is structurally and functionally equivalent to that of FIGS. 8-9B, except that flange extension 38 is in this case geometrically interlocked with the panel 18. The geometrical interlocking may be achieved by any suitable interlocking configuration such as, for example, a dovetail joint or a T-rail joint interconnection. Attachment of flange extension 38 may be performed by sliding the parts together prior to mounting of panel 18 on hinge jamb 12.

Turning now to FIGS. 12-18B, these illustrate a number of further implementations of the present invention in which flange 24 is part of a closed profile 50 forming at least part of panel 18. In this context, the term "closed profile" is used to refer to a structural element formed from material with a wall thickness less than the overall dimension of the profile, and where the shape of the profile in cross-section is closed, or substantially closed, thereby giving the element enhanced structural strength. The profile may have openings in certain cross-sections corresponding to localized holes for venting, filling, attachment to other elements, or for any other reason. The profile typically has an enclosed volume, which may be empty (or contain air) to form a hollow profile, or may be filed with foam or other filler with desired structural, acoustic or other properties. Depending upon the manufacturing technique used, the profile may be formed open at its ends, and is typically plugged at one or both of its ends by a suitable cap, typically incorporated into a transverse element extending along the top and/or bottom edge of the panel knot shown).

Figure 17A:
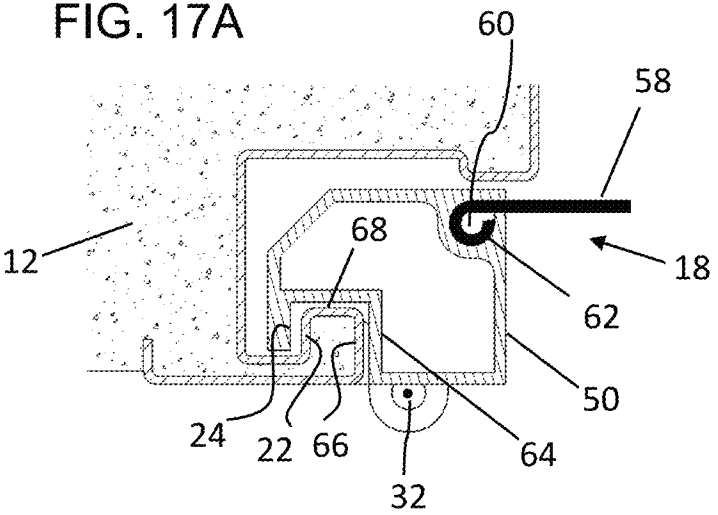
FIGS. 17A and 17B are partial, horizontal cross-sectional views taken through the door assembly of FIG. 16, shown with the panel in a closed state and a partially-open state, respectively.
Figure 17B:
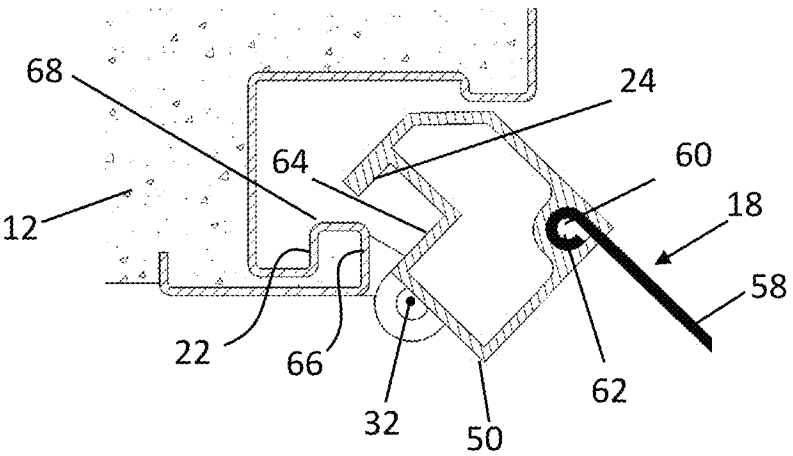

In the examples of FIGS. 12-13B and 14-15B, closed profile 50 is formed from at least one layer of sheet material, typically sheet metal, bent to form flange 24 and the closed profile. In the examples of FIGS. 16-17B, an extruded profile is used to anchor a sheet-metal panel element. The use of sheet metal in the construction of panels, such as for doors, provides a range of advantages. Such panels are typically relatively low in cost to produce via processes such as roll-forming or press-forming, and provide considerable mechanical strength. In security and blast-protection applications, sheet metal can withstand high loads for a given weight by acting as a diaphragm across the opening. However, such properties are only exhibited if the sheet metal is reliably anchored at its periphery. The various embodiments of the present invention illustrated herein provide effective solutions for such anchoring at the hinge side of the panel. Analogous closed-profile structures (not shown) are preferably used also at the strike jamb side of the panel in combination with a suitable locking mechanism, such as the mechanism illustrated above with reference to FIGS. 3A and 38.

Figure 12:
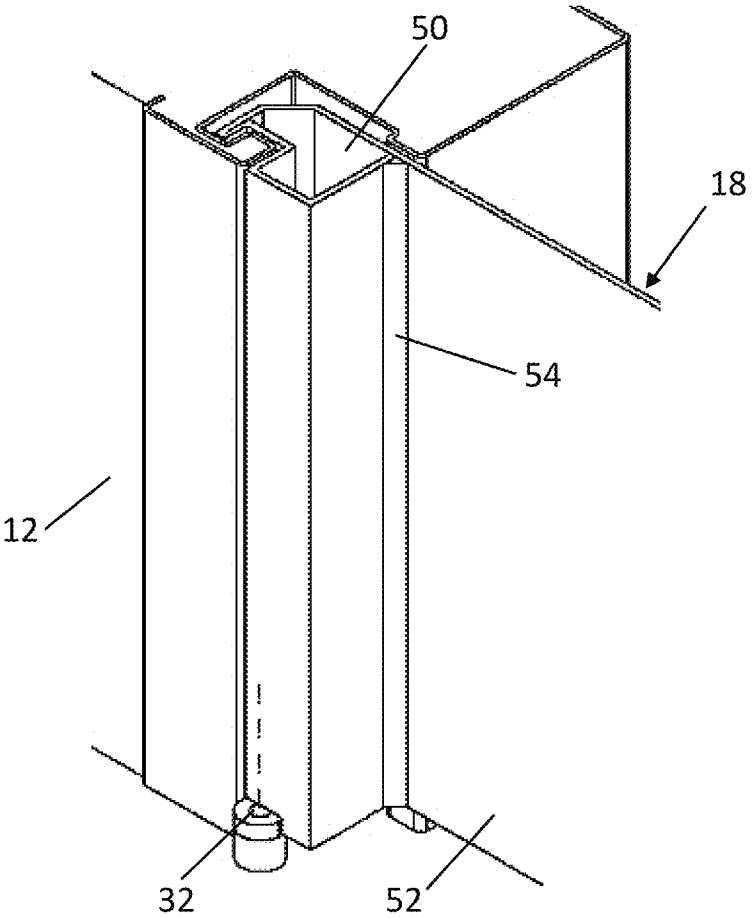
FIG. 12 is a partial, cut-away isometric view of the door assembly of FIG. 1 illustrating a further variant implementation of an engagement configuration implemented with a panel including a closed profile formed from a single sheet of material, constructed and operative according to an embodiment of the present invention, shown with the panel in a closed state.

In the case of FIGS. 12-138, closed profile 50 is formed from a single piece of sheet material 52 bent so as to form flange 24 and closed profile 50. Most preferably, the same single piece of sheet material also extends across a majority of the panel width, and typically also forms a closed profile at the opposite (strike jamb) side of the panel. Flange 24 is preferably formed by a part of the sheet folded back on itself to form a double-thickness flange. Optionally, the two thicknesses of the sheet forming flange 24 may be bonded together, for example, by spot welding or riveting. In order to provide enhanced rigidity, the folded edge of the sheet is preferably bonded to the part of the sheet against which it closes at bond 54 to form the closed profile. This bonding may be achieved by welding or any other suitable joining technique known for joining sheet metal. The bond 54 is preferably continuous, or at multiple locations sufficiently closely spaced as to provide rigidity similar to that which would be achieved by a continuous joint.

Figure 15A:
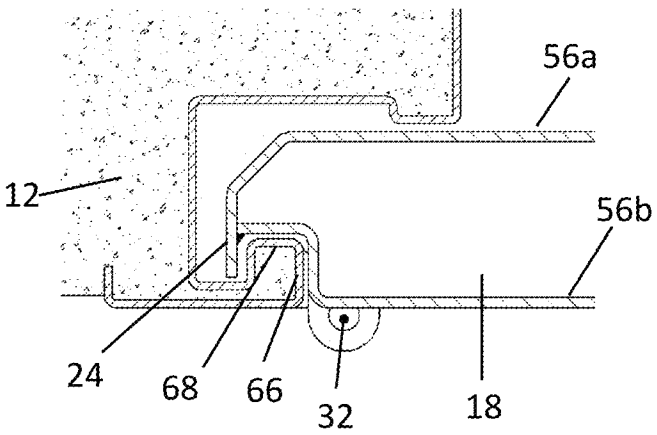
FIGS. 15A and 15B are partial, horizontal cross-sectional views taken through the door assembly of FIG. 14, shown with the panel in a closed state and a partially-open state, respectively.
Figure 15B:
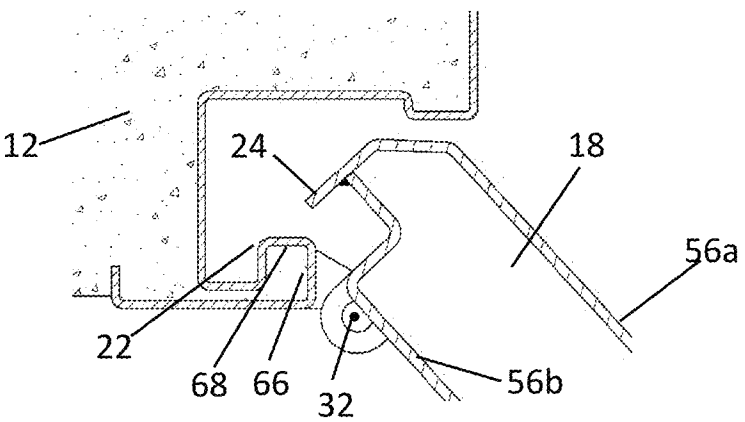
Figure 14:
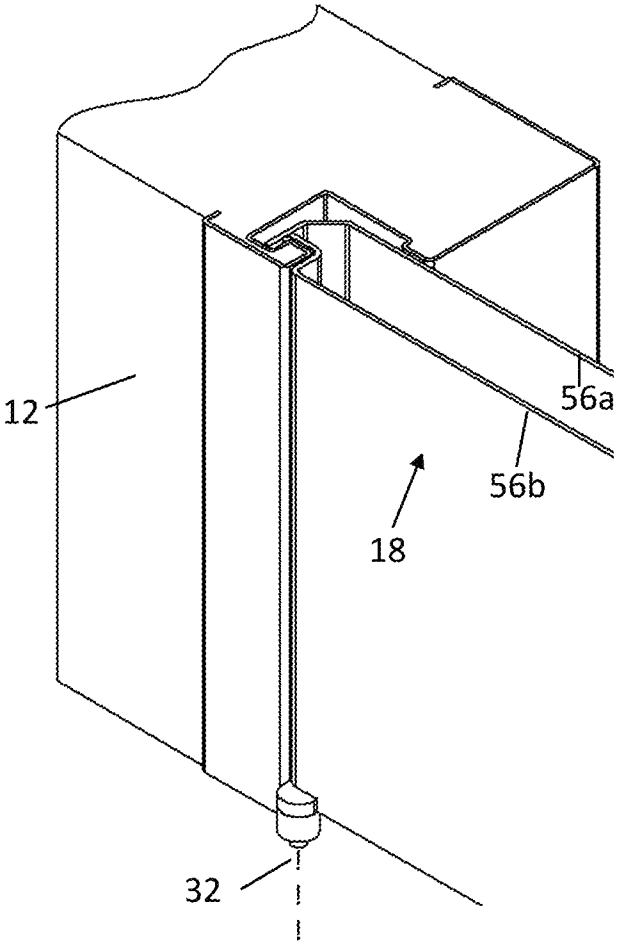
FIG. 14 is a partial, cut-away isometric view of the door assembly of FIG. 1 illustrating a further variant implementation of an engagement configuration implemented with a panel including a closed profile formed from two sheets of material, constructed and operative according to an embodiment of the present invention, shown with the panel in a closed state.
Figure 16:
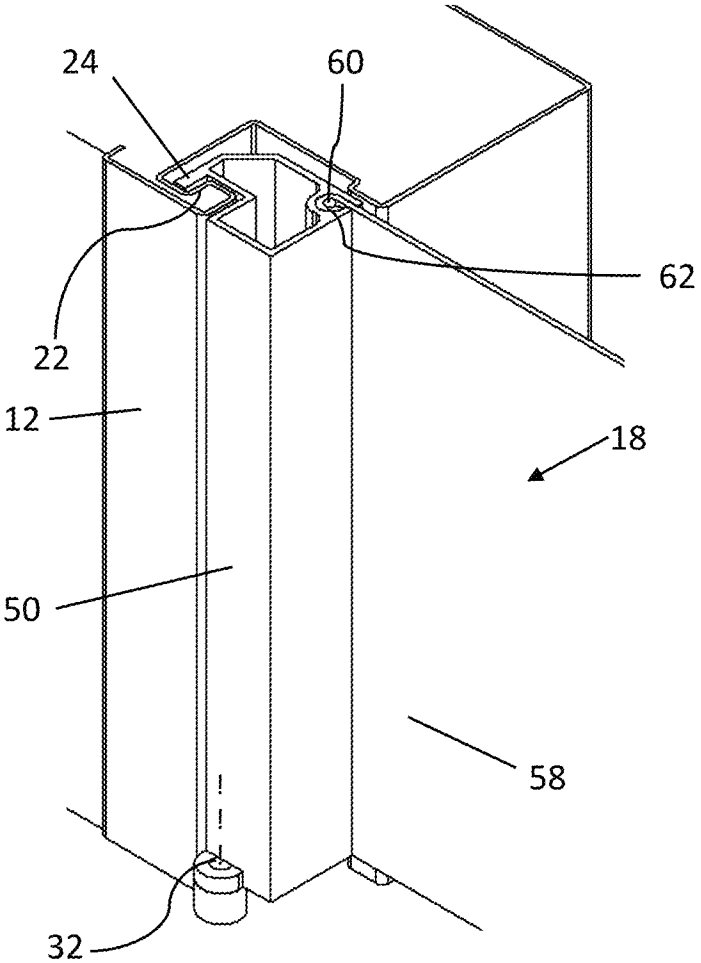
FIG. 16 is a partial, cut-away isometric view of the door assembly of FIG. 1 illustrating a further variant implementation of an engagement configuration implemented with a panel including an extruded closed profile, constructed and operative according to an embodiment of the present invention, shown with the panel in a closed state.

Turning now to FIGS. 14-15B, these illustrate an alternative embodiment in which panel 18 is formed primarily from two layers 56*a*, 56*b* of sheet material which cooperate to form a closed profile exhibiting a projecting flange 24. The two layers may meet and be joined at additional regions across the width of the panel, or may be joined only at the two edges. The panel is typically filled with, a suitable filler material (not shown).

Turning now to FIGS. 16-17B, these illustrate a further embodiment of the present invention according to which closed profile 50 is implemented as an extruded profile. The extruded profile may be formed from any extrudable material suitable for forming part of a door or window panel. Particularly preferred examples include aluminum and aluminum alloys, as well as carbon fiber-reinforced polymers.

In the example illustrated here, the closed profile is configured for mounting and retaining a sheet 58 of material, typically sheet metal, which forms a structural part of the panel. To this end, closed profile 50 here includes an elongated recess 60 which has an opening of dimension to receive a single thickness of sheet 58 and a shaped internal channel. Sheet 58 is formed with a lateral folded lip 62, which may be an L-shaped folded lip, or may be bent back on itself to form a doubled-over edge as shown here. Elongated recess 60 and lateral folded lip 62 are configured for sliding interengagement such that the folded lip can be slid into engagement with the shaped internal channel of recess 60 and is retained thereby against tension applied within the plane of the sheet. The hinge jamb engagement configuration provided by flange 24 and ledge 22 together with the anchoring of sheet 58 within recess 60 provides highly effective retention of sheet 58 on the hinge-jamb side of the panel. By using similar retention of sheet 58 in a strike jamb-side profile (not shown), and a suitable locking, mechanism for retaining the strike jamb-side profile to the strike jamb (such as that illustrated above with reference to FIGS. 3A and 3B), highly effective retention of sheet 58 is achieved, providing the aforementioned load-bearing properties of a diaphragm stretched across the opening in a light-weight and low-cost structure.

Turning now to a further preferred feature of certain embodiments of the present invention, it has been found that, depending upon the structure of the strike jamb-side locking mechanism and/or dependent upon circumstances in which a load is applied to try to pry the door away from the strike jamb, forces applied to the panel may sometimes include a large force within the plane of the closure towards the hinge jamb.

In the context of the particular ledge and flange interlocking of embodiments of the present invention, certain preferred embodiments of the present invention, have the hinge-side extremity of the panel located within a recess within hinge jamb 12. Accordingly, certain particularly preferred embodiments of the present invention provide surfaces deployed to provide effective support to oppose forces acting to displace the panel towards the hinge jamb.

Specifically, referring by way of a non-limiting example to the embodiments formed with a closed profile 50, the closed profile preferably features a shoulder 64, and hinge jamb 12 preferably features an abutment surface 66. Shoulder 64 and abutment surface 66 are deployed such that, when panel 18 assumes its closed position, shoulder 64 and abutment surface 66 are brought into facing relation such that force directed to displace panel 18 within the plane of closure towards hinge jamb 12 acts to bring shoulder 64 into engagement with abutment surface 66.

In the particularly preferred examples of FIGS. 12-18A, flange 24 and shoulder 64 are in facing relation, defining between them an elongated recess of closed profile 50. Ledge 22 and abutment surface 66 are then advantageously integrated into a projecting ridge 68 of hinge jamb 12 that is deployed so that it comes into engagement with the elongated recess of profile 50 when panel 18 assumes its closed position. It will be noted in the geometrical arrangement of FIGS. 12-18A that a certain clearance is required between flange 24 and ledge 22 to allow the required relative motion under rotation about hinge axis 32 to the closed position of the panel. Shoulder 64 and abutment surface 66, on the other hand, are preferably brought into close facing relation, typically with a clearance of no more than a few millimeters therebetween, and may in some cases be brought into direct contact, in the closed state of the panel.

Although illustrated here as being surfaces perpendicular to the plane of closure, it should be noted that shoulder 64 and abutment surface 66 may also be implemented with a range of different angles, analogous to the variant implementations of ledge 22 and flange 24 discussed above with reference to FIG. 5A.

Figure 18B:
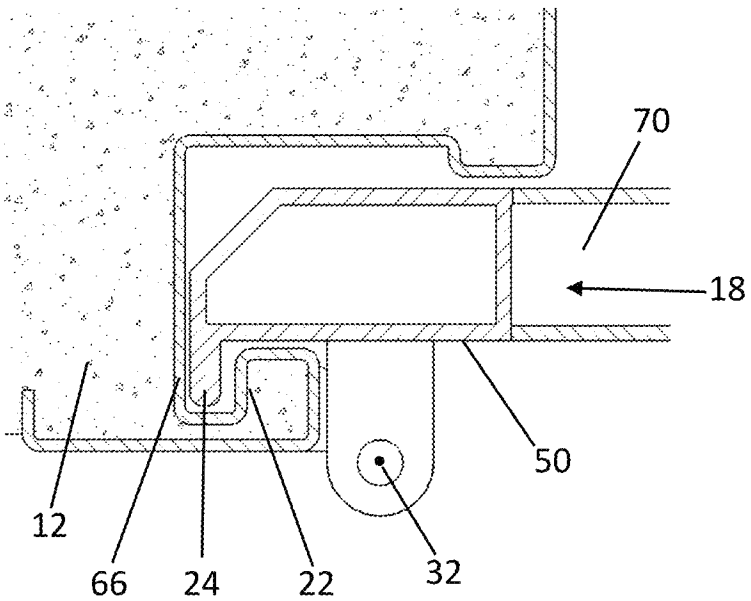
FIGS. 18A and 18B are partial, horizontal cross-sectional views taken through further variant implementations of an engagement configuration, constructed and operative according to an embodiment of the present invention, shown in a closed state of the panel, modified for a thick panel implementation and a thin panel implementation, respectively.
Figure 18A:
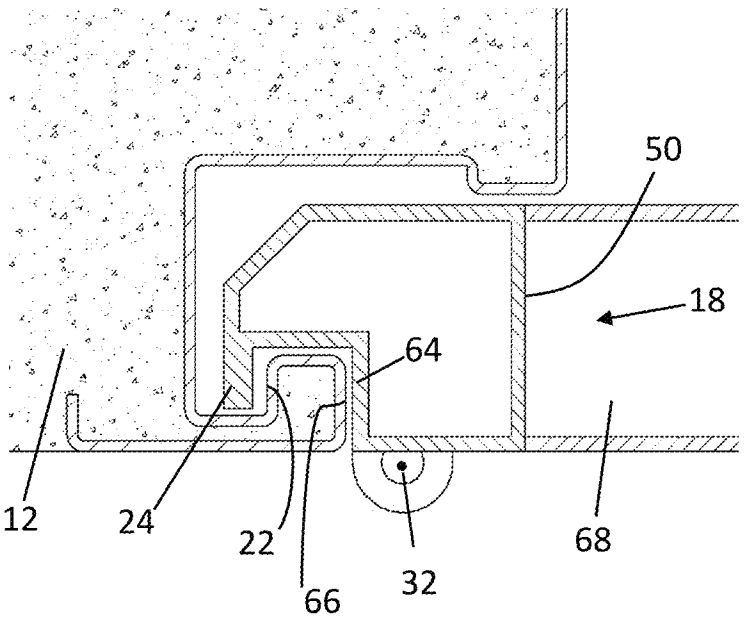

Turning finally to FIGS. 18A and 18B, these illustrate how the abutment surfaces may need to be varied in order to provide bidirectional support against in-plane forces for a range of different panel thicknesses. In the case of FIG. 18A, the form of closed profile 50 is essentially similar to that of FIG. 17A, except that the profile is here shown schematically with a generic thick panel structure 68. The aforementioned structure of an elongated recess between flange 24 and shoulder 64 is very suitable for providing the aforementioned bidirectional support.

FIG. 18B, on the other band, shows an implementation for use with a thin panel structure 70, and where it is desired to employ a correspondingly thin structure for closed profile 50. In this case, hinge jamb 12 is preferably implemented with an abutment surface 66 in facing relation With ledge 22 so as to define therebetween an elongated hinge-jamb recess. Flange 24 is deployed to engage this elongated hinge-jamb recess when the panel is in its closed position with a surface of flange 24 in facing relation with abutment surface 66 such that force directed to displace panel 18 within the plane of closure towards hinge jamb 12 acts to bring flange 24 into engagement with abutment surface 66.

It will be appreciated that the above descriptions are intended only to serve as examples, and that many other embodiments are possible within the scope of the present invention as defined in the appended claims.

What is claimed is:

1. An apparatus comprising:

(a) an opening bordered by a hinge jamb and a strike jamb, said hinge jamb and said strike jamb defining a plane of closure;

(b) a panel;

(c) a hinge arrangement associated with said panel and said hinge jamb and configured to hang said panel relative to said opening so as to be swingable about a hinge axis between an open position removed from said opening towards an opening side of the plane of closure and a closed position in which said panel is aligned parallel to said plane of closure within the opening, the hinge axis being set-in from an edge of the panel closest to said hinge jamb; and (d) an engagement arrangement comprising:

(i) a ledge located in fixed relation to said hinge jamb, and (ii) a flange rigidly associated with said panel, said engagement arrangement being configured such that said engagement arrangement does not obstruct swinging of said panel between said open position and said closed position, and such that, when said panel assumes said closed position, said flange is brought into facing relation with said ledge such that force directed to displace said panel within said plane of closure away from said hinge jamb acts to bring said flange into engagement with said ledge, and wherein said flange projects from a closed profile that forms at least part of said panel, and wherein at least part of said closed profile extends beyond said hinge axis so that said closed profile comes into overlapping relation behind part of said hinge jamb as viewed from the opening side of the plane of closure when said panel is in said closed position.

2. The apparatus of claim 1, wherein said closed profile is formed from at least one layer of sheet metal bent to form said flange and said closed profile.

3. The apparatus of claim 1, wherein said closed profile is formed from a single piece of sheet material bent so as to form said flange and said closed profile.

4. The apparatus of claim 1, wherein said closed profile is an extruded profile.

5. The apparatus of claim 1, wherein said panel is formed from at least two sheets of metal each extending substantially an entire width of said panel.

6. The apparatus of claim 1, wherein said closed profile includes an elongated recess, and wherein said panel includes a sheet of metal formed with a lateral folded lip, said elongated recess and said lateral folded lip being configured for sliding interengagement.

7. The apparatus of claim 1, wherein said closed profile further comprises a shoulder, and wherein said hinge jamb further comprises an abutment surface, said shoulder and said abutment surface being deployed such that, when said panel assumes said closed position, said shoulder and said abutment surface are brought into facing relation such that force directed to displace said panel within said plane of closure towards said hinge jamb acts to bring said shoulder into engagement with said abutment surface.

8. The apparatus of claim 7, wherein said flange and said shoulder are in facing relation defining between them an elongated recess of said closed profile, and wherein said ledge and said abutment surface are integrated into a projecting ridge of said hinge jamb, said projecting ridge coming into engagement with said elongated recess when said panel assumes said closed position.

9. The apparatus of claim 1, wherein said hinge jamb further comprises an abutment surface, said abutment surface being in facing relation with said ledge so as to define therebetween an elongated hinge jamb recess, said flange being deployed to engage said elongated hinge jamb recess when said panel assumes said closed position with said flange in facing relation with said abutment surface such that force directed to displace said panel within said plane of closure towards said hinge jamb acts to bring said flange into engagement with said abutment surface.

10. The apparatus of claim 1, wherein said engagement arrangement is configured such that contact between said flange and said ledge occurs only on application of sufficient force to cause damage to said hinge arrangement.

11. The apparatus of claim 1, wherein said panel further comprises a lock mechanism having a locking element displaceable to engage said strike jamb.

12. The apparatus of claim 11, wherein said locking element is a hook element configured to engage said strike jamb so as to oppose forces directed to pull said panel away from said strike jamb.

13. The apparatus of claim 1, wherein said hinge jamb is formed with a recess, and wherein at least part of said closed profile is deployed within said recess in said closed position of said panel.

14. The apparatus of claim 1, wherein said closed profile extends to said edge of said panel.

15. The apparatus of claim 1, wherein said flange projects from said closed profile in a direction perpendicular to said plane of closure when said panel is in said closed position.

16. The apparatus of claim 1, wherein a surface of said flange facing said ledge is angled such that, under a load, said flange and said ledge lock against each other.

17. An apparatus comprising:

(a) an opening bordered by a hinge jamb and a strike jamb, said hinge jamb and said strike jamb defining a plane of closure;

(b) a panel;

(c) a hinge arrangement associated with said panel and said hinge jamb and configured to hang said panel relative to said opening so as to be swingable between an open position removed from said opening and a closed position in which said panel is aligned parallel to said plane of closure within the opening; and (d) an engagement arrangement comprising:

(i) a ledge located in fixed relation to said hinge jamb, and (ii) a flange rigidly associated with said panel, said engagement arrangement being configured such that said engagement arrangement does not obstruct swinging of said panel between said open position and said closed position, and such that, when said panel assumes said closed position, said flange is brought into facing relation with said ledge such that force directed to displace said panel within said plane of closure away from said hinge jamb acts to bring said flange into engagement with said ledge, wherein said hinge arrangement includes a hinge support strip fixedly attached to said hinge jamb and extending along at least part of a length of said hinge jamb, and wherein said ledge is provided by an internal face of a slot formed in, and extending along, said hinge support strip.

18. The apparatus of claim 17, wherein said hinge support strip supports a plurality of hinge pin elements spaced along said hinge jamb, wherein a sum total length of said hinge pin elements is less than a sum total length of said ledge.

* * * * *